US009033536B2

(12) United States Patent
Shen et al.

(10) Patent No.: US 9,033,536 B2
(45) Date of Patent: May 19, 2015

(54) STATUS INDICATING DEVICE FOR A POWER NAIL GUN

(71) Applicant: Basso Industry Corp., Taichung (TW)

(72) Inventors: Yao-Sheng Shen, Taichung (TW); Jung-Mao Ho, Taichung (TW); Sheng-Man Wang, Taichung (TW); Chang-Sheng Lin, Taichung (TW)

(73) Assignee: Basso Industry Corporation, Taichung (TW)

( * ) Notice: Subject to any disclaimer, the term of this patent is extended or adjusted under 35 U.S.C. 154(b) by 146 days.

(21) Appl. No.: 13/798,670

(22) Filed: Mar. 13, 2013

(65) Prior Publication Data

US 2013/0242530 A1 Sep. 19, 2013

(30) Foreign Application Priority Data

Mar. 14, 2012 (TW) ..... 101108636 A

(51) Int. Cl.

| | |
|---|---|
| ***B25B 23/18*** | (2006.01) |
| ***F21V 33/00*** | (2006.01) |
| ***B25F 5/00*** | (2006.01) |

(52) U.S. Cl.

CPC ..... *F21V 33/0084* (2013.01); *B25F 5/00* (2013.01)

(58) Field of Classification Search

CPC ..... B25F 5/00; B25F 5/021; B25B 21/00; B25B 23/00; B25B 23/10; B25B 23/18

USPC ..... 362/119, 120

See application file for complete search history.

(56) References Cited

U.S. PATENT DOCUMENTS

| | | | | |
|---|---|---|---|---|
| 7,934,847 | B2 * | 5/2011 | Oomori et al. | 362/119 |
| 2005/0220445 | A1 | 10/2005 | Baskar et al. | |
| 2007/0046110 | A1 * | 3/2007 | Liu | 310/50 |
| 2009/0184148 | A1 | 7/2009 | Dittrich et al. | |
| 2009/0206122 | A1 * | 8/2009 | King | 227/142 |
| 2009/0207035 | A1 | 8/2009 | Watanabe et al. | |
| 2009/0236109 | A1 | 9/2009 | Wu et al. | |
| 2012/0106133 | A1 * | 5/2012 | Roehm | 362/119 |
| 2013/0076271 | A1 * | 3/2013 | Suda et al. | 318/3 |
| 2013/0126202 | A1 | 5/2013 | Oomori et al. | |

FOREIGN PATENT DOCUMENTS

| | | |
|---|---|---|
| EP | 2082842 | 7/2009 |
| EP | 2090399 | 8/2009 |
| JP | 2002210678 | 7/2002 |
| WO | WO 2012014503 | 2/2012 |

OTHER PUBLICATIONS

European Search report issued in EP 13 15 9030 (Oct. 14, 2013).

* cited by examiner

*Primary Examiner* — Thomas A Hollweg
*Assistant Examiner* — Kevin Quarterman
(74) *Attorney, Agent, or Firm* — Nixon & Vanderhye P.C.

(57) ABSTRACT

A status indicating device for a power nail gun includes a trigger adapted to be disposed on a gun body and having at least one transparent portion, and a light emitting module adapted to be disposed between the gun body and the trigger for emitting light through the transparent portion.

8 Claims, 5 Drawing Sheets

STATUS INDICATING DEVICE FOR A POWER NAIL GUN

CROSS-REFERENCE TO RELATED APPLICATION

This application claims priority of Taiwanese Application No. 101108636, filed on Mar. 14, 2012.

BACKGROUND OF THE INVENTION

1. Field of the Invention

This invention relates to a status indicating device, and more particularly to a status indicating device for a power nail gun, which can indicate status by light signal.

2. Description of the Related Art

Currently available power guns produce kinetic energy by electric power, pneumatic power, or gas explosion to perform a nail striking operation.

Referring to FIG. 1, a conventional power gun 1 includes a gun body 11, a trigger 12 disposed movably on the gun body 11 and operable for performing a nail striking operation, and a light emitting element 13. The gun body 11 has a handle 111. The light emitting element 13 is disposed on the handle 111 for emitting different light signals indicating battery status (such as saturated status or low electricity quantity status), gun operation status (such as standby status or nail striking status), or status of temperature in the gun body 11 (such as excessively high temperature), so as to achieve alarming effect.

However, since the light emitting element 13 is disposed on the handle 111 of the gun body 11, the handle 111 needs to have a light transmissive hole or area. Furthermore, during a nail striking operation, the path of light emitted from the light emitting element 13 may be shielded by the hand of the user, so that the user may be not aware of current status of the power nail gun, thereby resulting in inconvenience during use of the power nail gun.

SUMMARY OF THE INVENTION

The object of this invention is to provide a status indicating device for a power nail gun that can achieve effectively the status indicating effect.

According to this invention, there is provided a status indicating device adapted for a power nail gun, the power nail gun including a gun body and an electric control module disposed in the gun body for supplying electricity, the status indicating device comprising:

a trigger adapted to be disposed on the gun body and having at least one transparent portion; and a light emitting module adapted to be disposed between the gun body and the trigger for emitting light through the transparent portion.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
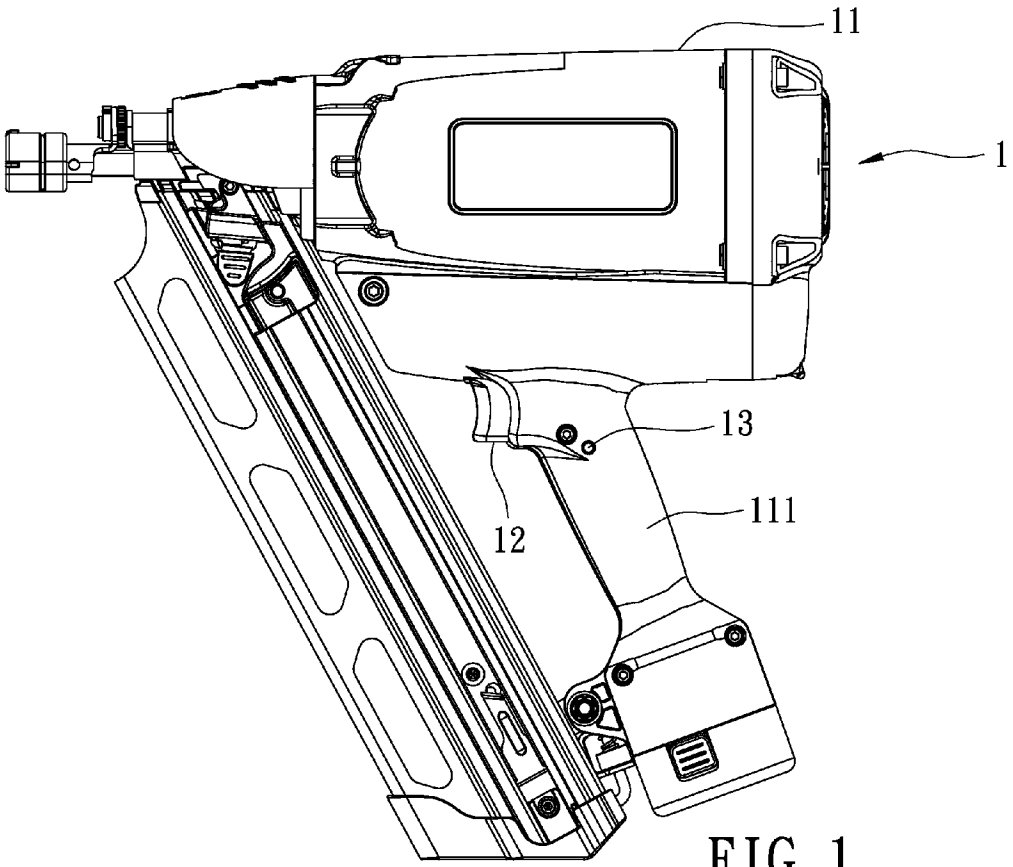
FIG. 1 PRIOR ART
FIG. 1 is a side view of a conventional power nail gun.
Figure 2:
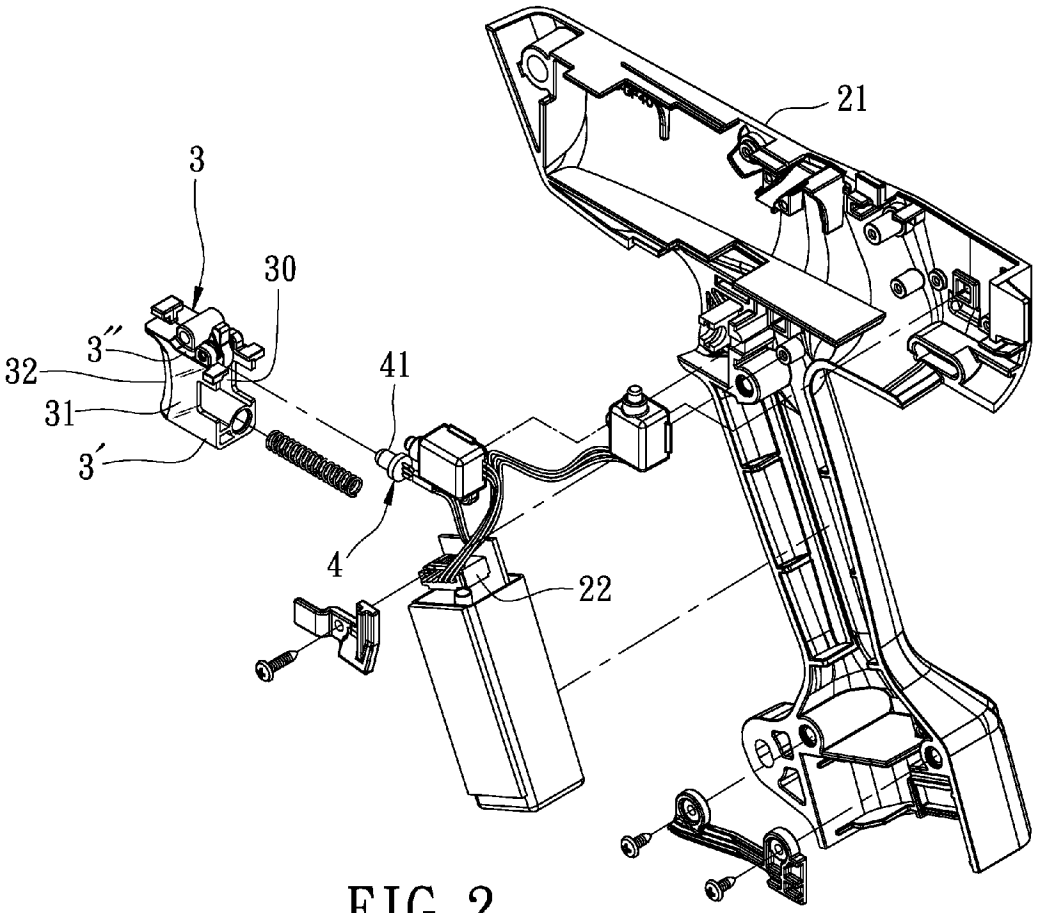
FIG. 2 is a partially exploded perspective view of a power nail gun including the preferred embodiment of a status indicating device according to this invention.
Figure 3:
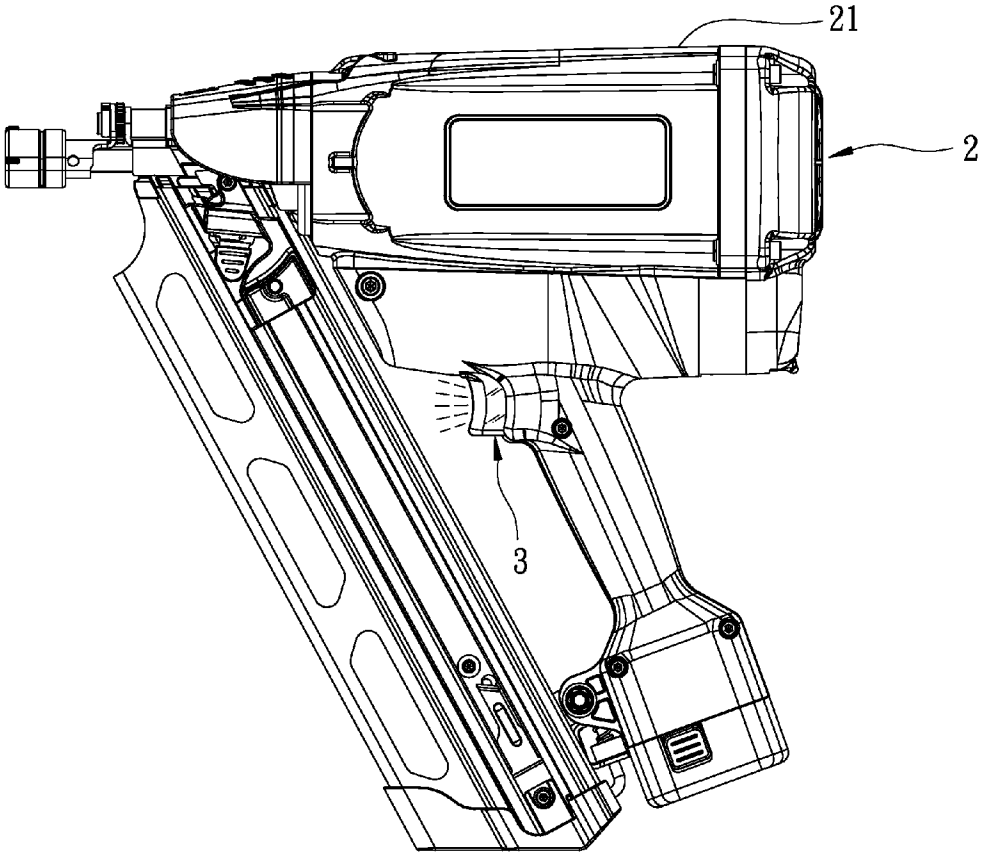
FIG. 3 is a side view of the power nail gun shown in FIG. 2.
Figure 4:
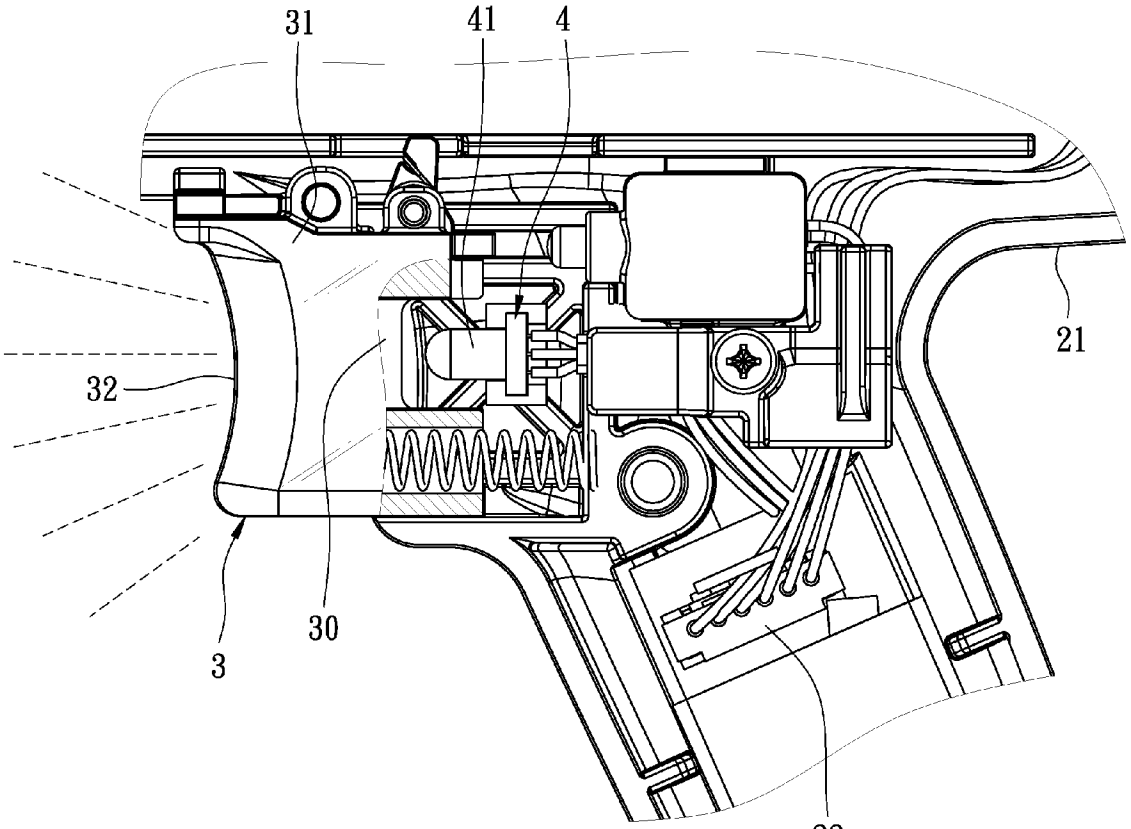
FIG. 4 is a partly sectional view of the power nail gun shown in FIG. 2.
Figure 5:
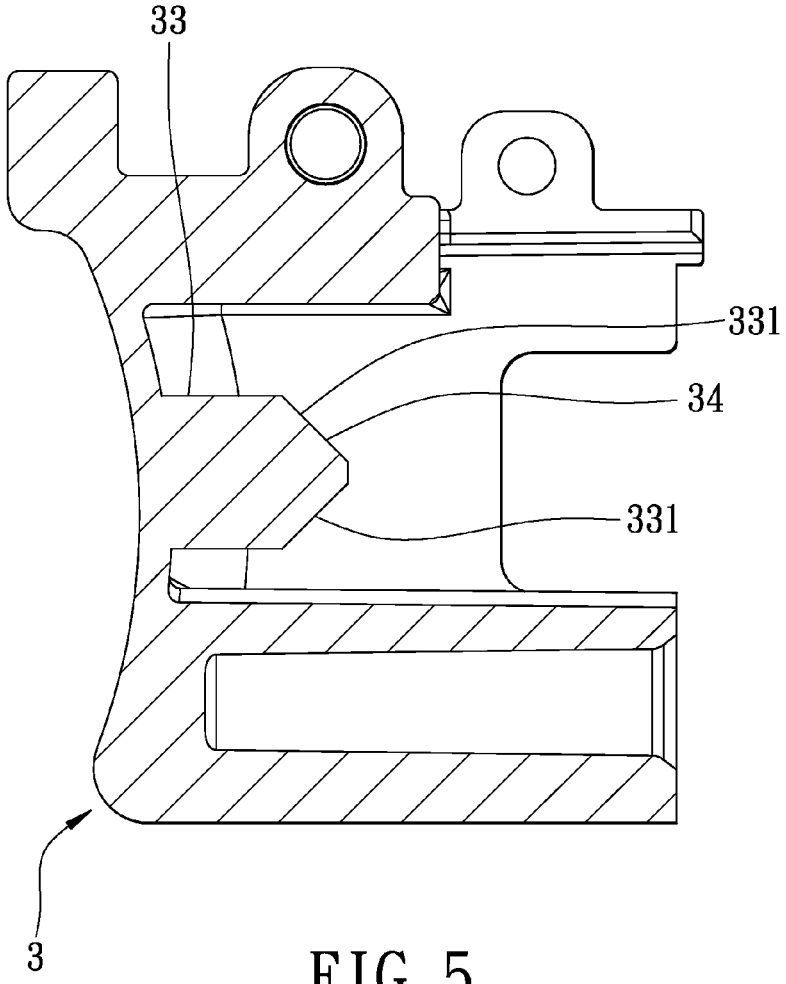
FIG. 5 is a fragmentary sectional view of the power nail gun shown in FIG. 2, illustrating a reflection layer.

Referring to FIGS. 2, 3, 4, and 5, the preferred embodiment of a status indicating device according to this invention is disposed within a power nail gun 2. The power nail gun 2 includes a gun body 21 and an electric control module 22 disposed in the gun body 21 for supplying electricity. The status indicating device includes a transparent trigger 3 and a light emitting module 4.

The trigger 3 is disposed on the gun body 21, is operable for controlling a nail-striking operation, and is movable between a first position proximate to the gun body 21 for triggering a nail-striking operation, and a second position distal from the gun body 21. In this embodiment, the trigger 3 is tubular, and has an open end 3' and a closed end 3" opposite to the open end 3', so as to define a receiving chamber 30 between the open end 3' and the closed end 3". The trigger 3 further has a surrounding wall 31 defining the receiving chamber 30 therein, an end wall 32 connected to the surrounding wall 31 and defining the closed end 3", and a projection 33 extending integrally from the end wall 32 into the receiving chamber 30.

The projection 33 has a tapered end shaped as a truncated quadrangular pyramid and having inclined top bottom surfaces 331 that face toward the light emitting module 4. The status indicating device further includes a reflection layer 34 applied on the top and bottom surfaces 331 for reflecting light.

The light emitting module 4 extends into the receiving chamber 30, is disposed between the gun body 21 and the trigger 3, and includes at least one light emitting element 41. In the embodiment, the light emitting module 4 includes only one light emitting element 41 configured as a light emitting diode. At least one of the light color and the flash frequency of the light emitting module 4 is changeable to indicate status of the power nail gun 2.

When the light emitting module 4 is energized through operation of the electric control module 22, light is radiated in the receiving chamber 30. A portion of the light is transmitted through the surrounding wall 31 and the end wall 32. The remaining portion of the light is emitted onto the reflection layer 34, and thus is reflected to pass through the surrounding wall 31.

As such, through change of the color or flash frequency of the light emitting element 41, the status indicating device can be operated in a plurality of different status indicating modes, so as to indicate at least one of battery capacity status, gun operation status, and status of temperature in the gun body 21.

For example, to indicate the battery capacity status, the light emitting module 4 can be set such that, green light indicates battery saturation status, green flashlight indicates battery high electricity quantity status (non-saturation), red flashlight indicates battery low electricity quantity status, and no light indicates battery lower electricity quantity protection status.

To indicate the status of temperature in the gun body 21, the light emitting module 4 can be set such that red light indicates excessively high temperature in the gun body 21 or excessively high temperature of the electric control module 22.

Alternatively, the trigger 3 has only one transparent position, which also can promote the status indicating effect.

As such, by changing the structure of the trigger 3, light can be emitted out of the power nail gun 2 through the trigger 3. In this manner, the visible range of the light signals is wider so that the light signals can be identified easily.

With this invention thus explained, it is apparent that numerous modifications and variations can be made without departing from the scope and spirit of this invention. It is therefore intended that this invention be limited only as indicated by the appended claims.

We claim:

1. A status indicating device adapted for a power nail gun, the power nail gun including a gun body and an electric control module disposed in the gun body for supplying electricity, said status indicating device comprising:

a trigger adapted to be disposed on the gun body and having at least one transparent portion; and a light emitting module adapted to be disposed between the gun body and said trigger for emitting light through said transparent portion;

wherein said trigger is tubular, and has an open end and a closed end opposite to said open end, so as to define a receiving chamber between said open end and said closed end, said light emitting module extending into said receiving chamber.

2. The status indicating device as claimed in claim 1, wherein said trigger further has a surrounding wall defining said receiving chamber therein, and an end wall connected to said surrounding wall and defining said closed end.

3. The status indicating device as claimed in claim 2, wherein said trigger is transparent.

4. The status indicating device as claimed in claim 3, further comprising a reflection layer, said trigger further having a projection extending integrally from said end wall into said receiving chamber, said projection having a tapered end that is configured as a truncated quadrangular pyramid and that has inclined top and bottom surfaces, said inclined top and bottom surfaces facing toward said light emitting module, said reflection layer being applied on said inclined top and bottom surfaces of said projection for reflecting light.

5. The status indicating device as claimed in claim 1, wherein said light emitting module includes at least one light emitting element.

6. The status indicating device as claimed in claim 5, wherein said light emitting element is a light emitting diode.

7. The status indicating device as claimed in claim 1, wherein at least one of light color and flash frequency of said light emitting module is changeable to indicate status of the power nail gun.

8. The status indicating device as claimed in claim 7, wherein said light emitting module is operable in a plurality of different status indicating modes to produce a plurality of light signals, so as to indicate at least one of battery capacity status, gun operation status, and status of temperature in the gun body.

* * * * *